US006039116A

United States Patent [19]

Stevenson et al.

[11] Patent Number: 6,039,116

[45] Date of Patent: Mar. 21, 2000

[54] OIL AND GAS PRODUCTION WITH PERIODIC GAS INJECTION

[75] Inventors: Mark D. Stevenson; Jerry L. Brady, both of Anchorage, Ak.

[73] Assignee: Atlantic Richfield Company, Los Angeles, Calif.

[21] Appl. No.: 09/073,215

[22] Filed: May 5, 1998

[51] Int. Cl.[7] ..... E21B 43/00; E21B 43/38; E21B 43/40

[52] U.S. Cl. ..... 166/263; 166/90.1; 166/105.5; 166/265; 166/306; 166/401; 166/268; 405/128

[58] Field of Search ..... 166/263, 306, 166/372, 90.1, 105.5, 265, 267, 268, 305.1, 401; 405/53, 128

[56] References Cited

U.S. PATENT DOCUMENTS

| | | | |
|---|---|---|---|
| 3,292,703 | 12/1966 | Weber | 166/306 |
| 3,995,693 | 12/1976 | Cornelius | 166/268 |
| 4,074,763 | 2/1978 | Stevens | 166/325 |
| 4,481,020 | 11/1984 | Lee et al. | 96/214 |
| 4,531,584 | 7/1985 | Ward | 166/265 |
| 4,632,601 | 12/1986 | Kuwda | 405/128 |
| 4,711,306 | 12/1987 | Bobo | 166/372 |
| 5,343,945 | 9/1994 | Weingarten et al. | 166/105.5 |
| 5,421,408 | 6/1995 | Stoisits et al. | 166/274 |
| 5,431,228 | 7/1995 | Weingarten et al. | 166/357 |
| 5,450,901 | 9/1995 | Ellwood | 166/266 |
| 5,482,117 | 1/1996 | Kolpak et al. | 166/265 |
| 5,570,744 | 11/1996 | Weingarten et al. | 166/357 |
| 5,698,014 | 12/1997 | Cadle et al. | 96/157 |
| 5,725,054 | 3/1998 | Shayegi et al. | 166/263 |
| 5,794,697 | 8/1998 | Wolflick et al. | 166/265 |
| 5,803,178 | 9/1998 | Cain | 166/306 |
| 5,937,946 | 8/1999 | Streetman | 166/267 |

OTHER PUBLICATIONS

"New Design for Compact Liquid–Gas Partial Separation", J.S. Weingarten et al, SPE 30637, Dallas, TX Oct. 22–25, 1995.

*Primary Examiner*—David Bagnell
*Assistant Examiner*—Jennifer R Dougherty
*Attorney, Agent, or Firm*—Drude Faulconer

[57] ABSTRACT

A method and apparatus for operating a well which has a wellbore which passes into both an oil and gas production zone and a gas injection zone. An oil and gas stream is produced from the production zone through the wellbore to the surface where gas is separated from the oil. After production is shut-in, gas is mixed with a carrier fluid at the surface to form a dense mixture which, in turn, is flowed down the same wellbore and through a downhole auger separator wherein a portion of the gas is separated from the mixture. The separated gas is injected into the injection zone with the remainder of the mixture being returned to the surface. At the conclusion of the injection cycle, the well is returned to production and, if desired, the process is repeated.

13 Claims, 3 Drawing Sheets

OIL AND GAS PRODUCTION WITH PERIODIC GAS INJECTION

DESCRIPTION

1. Technical Field

The present invention relates to a method and apparatus for producing oil and gas from one subterranean zone within a wellbore and periodically injecting gas back into another subterranean zone through the same wellbore and in one aspect relates to a method and apparatus for operating a well wherein oil and gas is produced from one subterranean zone for a period and is then stopped while gas, which is mixed with a carrier fluid, is flowed down the same wellbore wherein at least a portion of the gas in the mixture is separated downhole and injected into another subterranean zone.

2. Background

It is well known that many hydrocarbon reservoirs produce extremely large volumes of gas along with crude oil and other liquids. In producing fields such as these, it is not unusual to experience gas-to-oil ratios (GOR) as high as 25,000 standard cubic feet per barrel (scf/bbl.) or greater. As a result, large volumes of gas must be separated out of the liquids before the liquids are transported to storage or further processing or use. Where the production sites are near or convenient to large markets, this gas is considered a valuable asset when demands for gas are high. However, when demands are low or when the producing reservoir is located in a remote area, large volumes of produced gas can present major problems since production may have to shut-in or at least drastically reduced if the produced gas can not be timely and properly disposed of.

In areas where substantial volumes of the produced gas can not be marketed or otherwise utilized, it is common to "reinject" the gas into a suitable, subterranean formation. For example, it is well known to inject the gas back into a "gas cap" zone which usually overlies a production zone of a reservoir to maintain the pressure within the reservoir and thereby increase the ultimate liquid recovery therefrom. In other applications, the gas may be injected into a producing formation through an injection well to drive the hydrocarbons ahead of the gas towards a production well. Still further, the produced gas may be injected and "stored" in an appropriate, subterranean permeable formation from which it can be recovered later when the situation dictates.

To reinject the gas, large and expensive separation and compression surface facilities must be built at or near the production site. A major economic consideration in such facilities is the relatively high costs of the gas compressor train which is needed to compress the large volumes of produced gas to the pressures required for injection. As will be understood in this art, significant cost savings can be achieved if the gas compressor requirements can be downsized or eliminated altogether. To do achieve this, however, it is necessary to either raise the pressure of the gas at the surface by some means other than mechanical compression or else reduce the pressure required at the surface for injection of the gas downhole.

One method for accomplishing this objective is fully disclosed and claimed in co-pending and commonly-assigned U.S. application Ser. No. 09/072,657, filed May 5, 1998, filed concurrently herewith, wherein the compressor horsepower required to re-inject gas is substantially reduced or eliminated altogether. Basically, the effective bulk density of the gas to be injected is substantially increased by mixing the gas with a carrier fluid at the surface to form a mixture.

This mixture is flowed down a wellbore and through a downhole separator wherein at least a portion of the gas is separated before the gas is injected into the formation. The carrier fluid and any unseparated gas returns to the surface where it is further separated so that the carrier fluid can be recycled in the operation. However, this process requires the use of dedicated injection well(s) which, as will be understood in the art, may substantially increase the cost of this type of gas injection operation.

For various reasons (e.g. oversupply, etc.), it is not uncommon to shut-in production wells for periods of time ranging from one day to several weeks. If a production well(s) could be operated as an injection well(s) during these shut-in periods, the need for dedicated injection well(s) could be substantially reduced or eliminated altogether thereby significantly reducing the overall costs involved in the reinjection of the surplus gas.

SUMMARY OF THE INVENTION

The present invention provides a method and apparatus for operating a well which has a wellbore which passes into both an oil and gas production zone and a gas injection zone. Basically, an oil and gas stream is produced from the production zone to the surface through the wellbore where the stream is processed to separate the oil and the gas. After a production cycle, the production is shut-in and gas is then flowed down the same wellbore and injected into injection zone. In accordance with the present invention, the gas is first mixed with a carrier fluid at the surface to form a dense mixture. This mixture is then flowed through a downhole separator wherein a portion of the gas is separated from the mixture and is injected into the injection zone with the remainder of the mixture being returned to the surface. At the conclusion of the injection cycle, the well is returned to production.

More specifically, a well having a wellbore which passes into both a oil and gas production zone and a gas injection zone is completed wherein a string of tubing extends down the wellbore from the surface to a point substantially adjacent the injection zone wherein an annulus is formed between the tubing and the wellbore. A separator (e.g. auger separator) is positioned within the tubing near the lower end of the tubing and is movable between a first and a second position. The auger separator is basically comprised of a central tube which has an auger-like blade extending along a portion of its length. Spaced openings in the central tube provide a means for fluidly communicating the production zone with the separator when the separator is in its first operable position and for fluidly communicating the separator with the injection zone when in its second position.

In operation, the separator is set in its first position and oil and gas is produced from the production zone, through the separator, and to the surface. Aligned ports in the central tube and the tubing allow the gas which is separated in the separator to flow up either the well annulus or the tubing to the surface while the oil and any remaining gas flows up either the tubing or the annulus, respectively. At the conclusion of a production cycle, the flow of oil and gas is ceased and the well is converted from its production mode to its injection mode. This is done by lowering a wireline, coiled tubing, or the like to engage the separator and raise it to its second position within the tubing.

To begin gas injection, the effective bulk density of the gas to be injected is increased by mixing the gas with a dense, carrier fluid at the surface which, in turn, has been boosted to a relatively high pressures by a liquid pump or the like. The carrier fluid can be selected from a wide variety of liquids, e.g. water, brine, oil-based liquids, crude, etc. The mixture is flowed down the string of tubing in the wellbore and through the auger separator. Centrifugal force separates at least a portion of the gas (e.g. 75%) which flows through the central tube to the injection zone where the downhole pressures force the separated gas into the injection zone. The mixture of the carrier fluid and any unseparated gas flow upward from the separator to the surface through the annulus.

The mixture of carrier fluid and unseparated gas may be passed through another separator after it returns to the surface to separate the gas from the carrier fluid whereby the carrier fluid can be recycled. By effectively increasing the density of the gas at the surface by forming a mixture with a dense, carrier fluid, the gas does not need to be compressed at the surface before it is injected down the wellbore. As will be appreciated, by reducing or eliminating the need for gas compressors, the costs involved in disposing of excess gas through injection are substantially reduced. Further, by using production wells as gas injection wells during shut-in periods, the need for dedicated injection wells is eliminated or reduced which leads to additional, significant savings.

BRIEF DESCRIPTION OF THE DRAWINGS

The actual construction, operation, and apparent advantages of the present invention will be better understood by referring to the drawings which is not necessarily to scale and in which like numerals refer to like parts and in which.

BEST KNOW MODE FOR CARRYING OUT THE INVENTION

Figure 1:
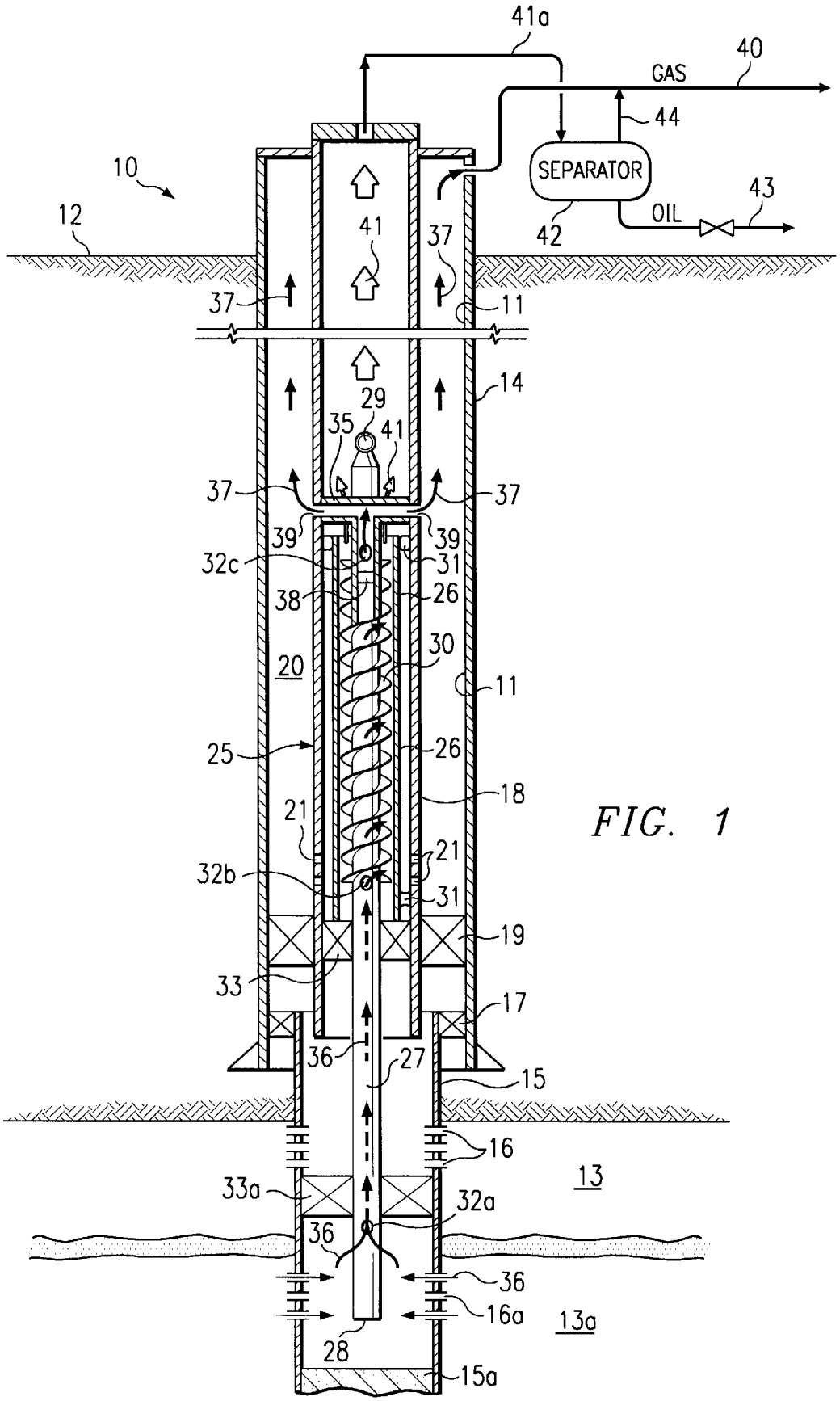
FIG. 1 illustrates a well completed in accordance with the present invention while operating in a production mode wherein the downhole separator is in a first position.

Referring more particularly to the drawings, FIG. 1 discloses a production well 10 having a wellbore 11 which extends from the surface 12, through an injection zone 13, and into a production zone 13*a*. As will be understood in the art, zones 13 and 13*a* may lie in the same subterranean formation or may be separate formations as shown. As illustrated, wellbore 11 is cased with a string of casing 14 to a point slightly above the upper or injection zone 13. A liner 15 or the like has openings 16 (e.g. perforations or slots) adjacent injection zone 13 and a second set of openings 16*a* adjacent production zone 13*a*. Liner 15 is suspended from the lower end of casing 14 and is closed at its lower end by cement plug 15*a* or the like. A packer 17 is provided near the top of liner 15 to block any substantial flow from around the outside of the liner into casing 14. While this is one well-known way to complete a well, it will be recognized that other equally as well-known techniques can be used without departing from the present invention: e.g., wellbore 11 may be cased throughout it entire length and then perforated adjacent both zones 13 and 13*a* or it may be completed "open-hole" adjacent these zones, etc.

A string of tubing 18 is positioned within casing 14 and extends from the surface substantially throughout the length of casing 14 and into liner 15. Packer 19 is positioned near the lower end of tubing 18 to block any flow in the annulus 20 between tubing 18 and casing 14 at that point. Tubing has at least one first opening or port 21(a plurality shown) near its lower end and at least one second opening or port 39 (two shown) spaced above said first opening 21 to provide fluid communication between the tubing 18 and annulus 20 for a purpose described below.

Figure 2:
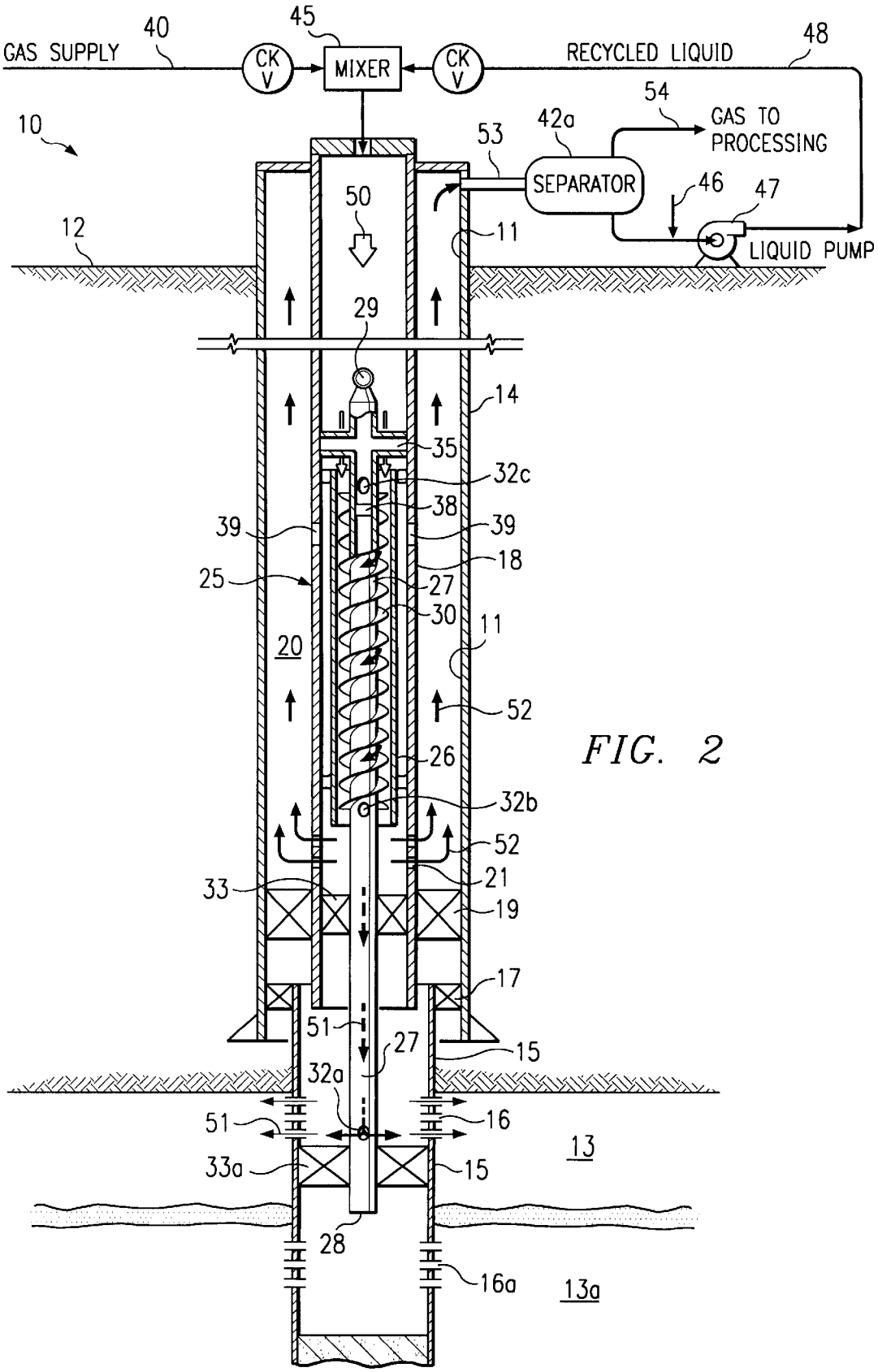
FIG. 2 illustrates the well of FIG. 1 wherein production has ceased and the well being operated in an injection mode wherein the separator is in a second position.

A separator (e.g. auger separator 25) is slidably positioned within tubing 18 near the lower end thereof and is movable between a first position (FIG. 1) and a second position (FIG. 2). Separator 25 can be positioned within tubing 18 and lowered therewith or, as will be understood, it can be lowered into the tubing on a wireline, coiled-tubing, or the like (not shown) and landed on a landing nipple (not shown) or the like within the tubing after the tubing 18 has been positioned within the wellbore. Auger separators are known in the art and are disclosed and fully discussed in U.S. Pat. No. 5,431,228 which issued Jul. 11, 1995, which, in turn, is incorporated herein in its entirety by reference.

Also, for a further discussion of the construction and operation of such separators, see "New Design for Compact-Liquid Gas Partial Separation: Down Hole and Surface Installations for Artificial Lift Applications", Jean S. Weingarten et al, SPE 30637, Presented Oct. 22–25, 1995 at Dallas, Tex. As fully disclosed and explained in the above cited references, an auger separator (i.e. separator 25) is basically comprised of a central tube which has an auger-like blade thereon. The separator separates at least a portion of the gas from a flowing, mixed liquid-gas stream as it follows the spiral path of the auger blade. The liquid in the stream is forced to the outside of the blade by centrifugal force while at least a portion of the gas is separated from the stream and remains near the wall of the center tube. As the stream reaches the end of the blade, the separated gas will flow through an inlet port in the tube while the liquid and remaining gas will continue to flow along the outside of tube, and then back to the surface.

Auger separator 25, as shown, is comprised of a housing 26 having a center or central conduit or tube 27 extending therethrough which, in turn, has a spiral, auger-like blade 30 affixed on its outer surface. Seals 31 (O-ring or the like) are provided on either end of housing 26 to effectively block flow between the housing and the tubing 18 for a purposed described below. As shown in FIG. 1, when well 10 is in a production mode, housing 26 may rest on packer 33 or the like which, in turn, is affixed in tubing 18. The central tube 27 of auger separator 25 slidably extends through central openings in both packer 33 or the like, which is positioned within tubing 18, and packer 33*a* or the like, which is positioned within liner 15 between zones 13 and 13*a* for a purpose discussed below.

Tube 27 is closed at its lower end 28 and has a wireline connection 29 or the like at its upper end which, in turn, is used in positioning separator 25 within tubing 18, as will be explained in detail below. Central tube 27 has four openings spaced along its length—i.e. opening 32*a* near its lower end; opening 32*b* just below the lower end of auger blade 30; and opening 32*c* near its upper end—and a T-shaped opening or ports 35 at the upper end of the fluid passage of tube 27; the purposes of each of these openings will be explained below.

When well 10 is in a production mode, separator 25 is in its lower position as shown in FIG. 1. As will be understood by those skilled in the art and as will become evident from the description below, separator 25 is slidable within tubing 18 and is operated similarly as are well-known, downhole "sliding valves" which are used to open and close ports in a tubing or the like. Oil and gas (arrows 36) flow from production zone 13*a*, through perforations 16*a*, and into central tube 27 through opening 32*a*. The oil-gas stream 36 flows up tube 27, past packers 33 and 33*a*, and out into housing 26 through opening(s) 32*b* where it then flows upward through separator 25.

As the oil-gas stream 36 follows the spiral path along auger blade 30, at least a portion of the gas (arrows 37) is separated from the stream by centrifugal force as explained above. The separated gas 37 re-enters tube 27 through upper opening 32*c*. Flow within tube 27 between openings 32*b* and 32*c* is blocked by a plug 38 or the like so the separated gas 37 can only exit to annulus 20 through ports 35 which, in turn, are aligned with upper ports 39 in tubing 18. The separated gas flows upward through annulus 20 and into line 40 for transport to market, use at the well site, or for re-injection into a well as will be explained in detail below.

The stream of oil and any remaining unseparated gas (arrows 41) will flow upward from separator 25 through tubing 18 to the surface and through line 41*a* to separator 42 wherein the remaining gas is separated from the oil. The oil is removed from separator 42 through line 43 while the gas is removed through line 44 to be combined with the gas in line 40, if desired, or otherwise disposed of.

When the production from well 10 is shut-in during periods of oversupply or the like, the well is converted into its "injection mode" (FIG. 2) by lowering a wireline, coiled tubing, or the like (not shown) which engages the connection 29 at the top of separator 25. Separator 25 then raised within tubing 18 until lower opening 32*a* in central tube 27 is in fluid communication with injection zone 13 through openings 16 in liner 15. That is, lower opening 32*a* in central tube 27 will now lie above packer 33*a* which, in turn, is positioned within liner 15 between production zone 13*a* and injection zone 13. The raising of separator 25 will also move ports 35 at the upper end of central tube 27 out of alignment with upper ports 39 in tubing 18 thereby blocking flow through each of these respective ports. Once well 10 is in its injection mode, gas can now be injected into injection zone 13.

To do this in accordance with the present invention, the effective density of the gas to be injected is increased at the surface before it is fed down wellbore 11. This is done by blending a dense, carrier fluid (e.g. liquid) with the gas at the surface to form a mixture having a bulk density between that of the blended fluid and that of the gas. Dense carrier fluids may include any fluids which will suspend the gas in the mixture but at the same time, will allow separation of at least a part of the gas as the mixture passes through auger separator 25. This may include a wide variety of fluids; e.g. water; brine (e.g. produced water, seawater, etc. with or without corrosion inhibitors); oil-based liquids such as oil-based drilling muds or the like; petrochemicals such as glycol; stabilized or volatile crudes, or esoteric fluids such a "heavy media", i.e. suspensions of fine particles of metal or the like such as fine iron filings in water. The gas and the carrier liquid are mixed so that the density of the resulting mixture when flowed under pressure (i.e. pumped) down wellbore 11 will overbalance the bottom-hole pressure within injection zone 13, as will be more fully discussed below.

As shown in FIG. 2, gas is supplied to mixer 45 through line 40. This is the gas which typically has been produced and then separated from the production stream of FIG. 1. Carrier liquid from surface separator 42*a* (to be discussed later) and/or from a separate source 46 is pumped under pressure by pump 47 through line 48 into mixing chamber 45 or other mixing device to form a carrier liquid-gas mixture. A foaming agent (e.g. sulphonates, polysulphonates, long-chain alcohols, etc.) may be added to the mixture (e.g. within mixer 45) to prevent "slugging" as the mixture flows downward in tubing 18 as will be understood in the art.

This mixture (arrows 50) flows down tubing 18 (FIG. 2) and through auger separator 25 where centrifugal force separates at least a portion of the gas from the mixture as explained above. The separated gas (arrows 51 in FIG. 2) passes through port(s) 32*b* in central tube 27 and exits into liner 15 through opening(s) 32*a* which now lies above packer 33*a* which, in turn, blocks any substantial downward flow in liner 15. Packers 17 and 19 block any substantially upward flow of gas so the gas in liner 15 can only flow through openings 16 and into zone 13 as the gas accumulates and the pressure increases in within liner 15.

The dense carrier liquid plus any remaining gas mixture (arrows 52 in FIG. 2) flows along the outside of blade 30 of separator 25 and will pass through port(s) 21 in tubing 18 as it reaches the bottom of blade 30. The carrier liquid-unseparated gas mixture 52 will flow to the surface through well annulus 20, through line 53, and into surface separator 42*a* (may be the same separator as 42 in FIG. 1) where the remaining gas is separated from the carrier liquid. Any separated gas is taken from separator 42*a* through line 54 to be used as fuel or otherwise properly disposed of. The carrier liquid is taken from separator 42*a* through line 48 and is preferably recycled to mixer 45 through pump 47 to be reused in the ongoing gas injection operation. It should be understood that carrier liquid may be added or removed from the circuit through line 46 as a particular situation may dictate. Alternately, the liquid may pass with the gas through line 54 to be processed downstream.

In order to inject gas into zone 13, the pressure of the separated gas in liner 15 has to be greater than the pressure within zone 13. Accordingly, the pressure of the carrier liquid-gas mixture at the surface must be sufficient to overbalance the well pressure thereby allowing the mixture to flow down the wellbore 11. This pressure is doctated by the pressure of the gas supply. Given that pumping liquid is easier than compressing gas, the pressure of he liquid in line 48 is substantially matched to the available gas pressure. The liquid pressure is generated at the surface primarily by pump 47 as it pumps the carrier-liquid to mixer 45. By generating the necessary pressure through the pumping of liquid, the more-costly gas compression is substantially reduced or eliminated thereby significantly reducing the costs involved in the gas injection operation.

To further illustrate the present invention, an idealized example of a typical operation carried out when well 10 is in its injection mode will now be set forth. Gas is to be injected into a injection zone 13 which has a formation pressure of approximately 3500 psia. Gas is fed to mixer 45 at a rate of 26.7 million cubic feet per day at a pressure of approximately 1950 psia while carrier liquid (e.g. water) is pumped into mixer 45 at a rate of 12000 bbls. per day at a pressure of approximately 1950 psia. A carrier-gas mixture 50 having a density of about 21.6 lbs./cu.ft. leaves mixer 45 at a pressure of about 1950 psia and flows down wellbore 11. As the mixture flows through auger separator 25, approximately 75%; of the gas will be separated from the mixture and will flow into liner 15 at a pressure of about 3730 psia. Since this pressure is greater than the formation pressure in zone 13, the gas will enter the zone, as will be understood in the art. The differential in pressure between that of the mixture 50 as it enters the top of tubing 18 and the pressure at bottom of annulus 20 causes the carrier liquid-unseparated gas mixture 52 to flow back to the surface. The unseparated gas expands as the mixture passes up annulus 20 thus assisting the lifting of the liquids.

When gas injection is completed or well 10 is to be returned to its production mode, flow of mixture 50 is ceased and separator 25 is again lowered to the positioned shown in FIG. 1. The well is now ready to resume production which is continued until the next shut-in period, at which time, separator 25 can be raised within the tubing and another cycle of gas injection can be carried out. This production-injection cycling can continue during the production life of well 10.

Figure 3:
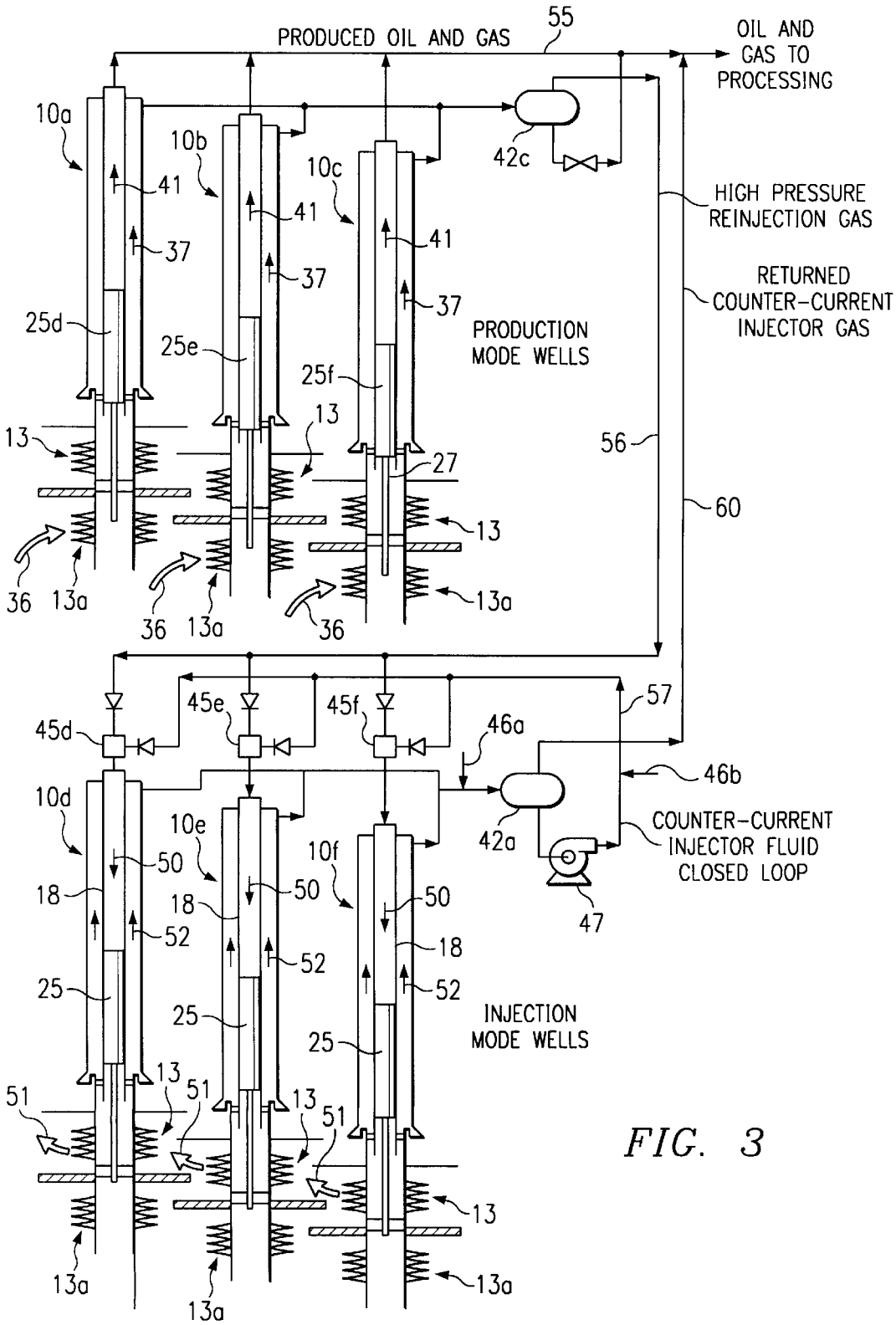
FIG. 3 is a schematic illustration of a plurality of wells manifolded together wherein some are being operated in the production mode while others are being operated in the injection mode.

FIG. 3 illustrates a system wherein one or more wells (3 shown) which are being operated in a production mode are manifolded with others wells which, at the same time, are being operated in an injection mode. More specifically, as shown, six wells 10*a–f* have been completed in accordance with the present invention. In wells 10*a–c*, downhole separators 25 are in their first or down position wherein oil and gas is being produced from production zone 13*a*. As illustrated, the gas 37 which has been separated downhole by separators 25 in wells 10*a–c* is manifolded and fed into separator 42*c* while the oil and remaining gas stream 41 is manifolded into line 55 to be passed on for further processing. The gas 37 will be at a higher pressure that that of stream 41. Oil is removed from separator 42*c* and is combined with the stream in line 55 while the gas from the separator is manifolded into line 56.

Gas is fed from line 56 into mixers 45*d–f*, respectively, where it is mixed with a carrier fluid from line 57. The carrier fluid is selected from the same group or liquids set forth above and can be recycled carrier fluid from separator 42*a* or it can be added into the circuit through line 46*a* before the pressure of the fluid is boosted by pump 47 or through 46*b* after the pressure has been boosted. The mixture 50 is fed down a respective well 10*d–f* which is in an injection mode wherein separators 25*d–f*, respectively, have been raised to their up positions.

As explained above, gas 51 is separated from the mixture as it passes through auger separator 25 and is injected into injection zone 13. The carrier fluid and unseparated gas 52 returns to the surface and is fed to separator 42*a* which, in turn, separates the remaining gas from the carrier fluid. The gas from separator 42*a* may be combined into line 55 through line 60 while the carrier fluid from the separator can be recycled through line 57.

By being able to quickly and relatively inexpensively switch a well between a production mode and an injection mode, the expense of having dedicated injection wells can be eliminated or at least significantly reduced.

What is claimed is:

1. A method of operating a well having a wellbore which passes into both an oil and gas production zone and a gas injection zone, said method comprising:

producing oil and gas from said production zone and up to the surface through said wellbore;

ceasing the production of said oil and gas from said production zone;

mixing gas with a carrier fluid at the surface to form a mixture therewith;

flowing said mixture down said wellbore;

separating at least a portion of said gas from said mixture as said mixture flows down said wellbore; and injecting said separated portion of said gas into said injection zone.

2. The method of claim 1 including:

stopping the flow of said mixture down said wellbore; and resuming production of oil and gas from said production zone through said wellbore.

3. The method of claim 1 including:

returning the mixture of said carrier fluid and any unseparated gas to said surface after said at least a portion of said gas has been separated therefrom.

4. The method of claim 1 wherein said carrier fluid is selected from the group of water, brine, oil-based liquids, crudes, petrochemicals, and heavy media.

5. The method of claim 3 including:

separating said unseparated gas from carrier fluid after said mixture of said carrier fluid and any unseparated gas is returned to the surface; and recycling said separated carrier fluid for mixing with said gas to be injected.

6. A method of operating a well having a wellbore extending from the surface into both a subterranean oil and gas production zone and a gas injection zone and having a string of tubing extending within said wellbore with a downhole separator slidably positioned within said tubing at a point substantially adjacent the top of said gas injection zone, said method comprising:

producing oil and gas from said production zone and up to the surface through said wellbore;

ceasing the production of said oil and gas from said production zone;

mixing gas with a carrier fluid at the surface to form a mixture therewith;

flowing said mixture through said separator within said tubing to thereby separate at least a portion of said gas from said mixture;

injecting said separated portion of said gas into said subterranean gas injection zone; and returning the mixture of said carrier fluid and any unseparated gas to said surface.

7. The method of claim 6 wherein said carrier fluid is selected from the group of water, brine, oil-based liquids, crudes, petrochemicals, and heavy media.

8. The method of claim 6 wherein said separator is an auger separator.

9. The method of claim 6 including;

separating said unseparated gas from carrier fluid after said mixture of said carrier fluid and any unseparated gas is returned to the surface; and recycling said separated carrier fluid for mixing with said gas to be injected.

10. Apparatus for alternately producing oil and gas through a wellbore from a subterranean production zone and injecting gas into a subterranean injection zone within the same wellbore; said apparatus comprising:

a string of tubing positioned within said wellbore and extending from said surface to a point substantially adjacent said injection zone wherein an annulus is formed between said tubing and said wellbore;

a separator positioned with said tubing near the lower end thereof and movable between a first position and a second position;

means for fluidly communicating said production zone with said separator when said separator is in said first position whereby said oil and gas from said production zone flows through said separator and to the surface;

means for fluidly communicating said injection zone with said separator when said separator is in said second position whereby gas flowing from the surface flows through said separator and into said injection zone;

a mixer for mixing said gas flowing from the surface with a carrier fluid at the surface to form a mixture whereby a portion of said gas is separated from said mixture as it flows through said separator when said separator is in said second position; and means for returning the mixture of said carrier fluid and any unseparated gas to the surface.

11. The apparatus of claim 10 wherein said separator is an auger separator.

12. The apparatus of claim 11 wherein said auger separator comprises:

a central tube extending from near the lower end of said tubing and having an opening near its lower end which lies in fluid communication with said production zone when said separator is in said first position and which lies in fluid communication with said injection zone when said separator is in said second position; and an auger blade affixed to and extending along a portion of said central tube.

13. The apparatus of claim 10 including:

a separator at the surface for separating said unseparated gas from said mixture of said carrier fluid and any unseparated gas after said mixture is returned to the surface.

* * * * *